US006559816B1

(12) United States Patent
Koo et al.

(10) Patent No.: US 6,559,816 B1
(45) Date of Patent: May 6, 2003

(54) METHOD AND APPARATUS FOR ERASING LINE IN PLASMA DISPLAY PANEL

(75) Inventors: Bon Cheol Koo, Daeku-shi (KR); Jae Hyuck Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 97 days.

(21) Appl. No.: 09/611,946

(22) Filed: Jul. 6, 2000

(30) Foreign Application Priority Data

Jul. 7, 1999 (KR) ..... 99-27262
Jul. 8, 1999 (KR) ..... 99-27381
Sep. 29, 1999 (KR) ..... 99-41682

(51) Int. Cl.[7] ..... G09G 3/28; G09G 5/00
(52) U.S. Cl. ..... 345/60; 345/63; 345/213
(58) Field of Search ..... 345/60, 63, 67, 345/68, 213, 182; 313/685, 585

(56) References Cited

U.S. PATENT DOCUMENTS 3,733,435 A * 5/1973 Chodil et al. ..... 315/169.1
6,097,357 A * 8/2000 Shinoda et al. ..... 313/485
6,104,362 A * 8/2000 Kuriyama et al. ..... 345/213
6,335,712 B1 * 1/2002 Kim ..... 315/169.4
6,356,249 B1 * 3/2002 Lim ..... 345/63

* cited by examiner

*Primary Examiner*—Vijay Shankar
*Assistant Examiner*—Prabodh Dharia
(74) *Attorney, Agent, or Firm*—Fleshner & Kim, LLP

(57) ABSTRACT

A line erasing method and apparatus for a plasma display panel that is capable of reducing a brightness difference between lines thereof. In the method and apparatus, a load amount per line is detected for lines including a pair of electrodes for causing a sustaining discharge to control a sustaining interval in accordance with a deviation in the load amount per line.

26 Claims, 13 Drawing Sheets

METHOD AND APPARATUS FOR ERASING LINE IN PLASMA DISPLAY PANEL

BACKGROUND OF THE INVENTION

1. Field of the Invention

This invention relates to a driving method and apparatus for a plasma display panel, and more particularly to a line erasing method and apparatus for a plasma display panel that is adapted to reduce a brightness difference between lines in the plasma display panel.

2. Description of the Related Art

Recently, a plasma display panel (PDP) feasible for a manufacturing of large-dimension panel has been highlighted as a plat panel display device. The PDP seals a discharge gas between two opposite glass substrates to provide a discharge space. Within this discharge space, electrodes for causing a discharge and barrier ribs for preventing optical and electrical interference between cells are provided.

Referring to FIG. 1, there is shown a conventional AC-type PDP driving apparatus that includes a PDP 100 having (m×n) cells 101 arranged in a matrix type, a scanning electrode driver 104 for driving scanning electrode lines Y1 to Ym in the PDP 100, a sustaining electrode driver 106 for driving sustaining electrode lines Z1 to Zm in the PDP 100, and first and second address electrode drivers 102A and 102B for supplying address electrode lines X1 to Xn in the PDP 100 with a data. The scanning electrode driver 104 sequentially applies a scanning pulse and a sustaining pulse to the scanning electrode lines Y1 to Ym, thereby scanning the cells 101 sequentially for each scanning line and sustaining a discharge at each of the selected cells 101. The sustaining electrode driver 106 applies a sustaining pulse to all the sustaining electrode lines Z1 to Zm. The first address electrode driver 102A supplies odd-numbered address electrode lines X1, X3, . . . , Xn-3, Xn-1 with a video data, whereas the second address driver 102B supplies even-numbered address electrode lines X2, X4, . . . , Xn-2, Xn with a video data.

The conventional PDP driving apparatus further includes a data array 108 receiving a video data from the input line, a frame memory 112 and a data output 114 connected between the data array 108 and the address electrode drivers 102A and 102B, a controller 110 for controlling the data array 108 and the frame memory 112, and a timing signal generator 116 for generating a timing signal under control of the controller 110. The data array 108 rearranges the input video data for each bit under control of the controller 110. The frame memory 112 stores a bit data inputted from the data array 108 under control of the controller 110 and supplies the data output 114 with the stored bit data. The data output 114 divides data from the frame memory 112 into one for odd-numbered cells and one for even-numbered cells to supply the divided data to the address electrode drivers 102A and 102B. Under control of the controller, the timing signal generator 116 applies a data latch signal to the address electrode drivers 102A and 102B and applies timing signals indicating an application time of a writing pulse, a scanning pulse, a sustaining pulse and an erasing pulse to the scanning electrode driver 104 and the sustaining electrode driver 106. The controller 110 receives a clock signal CLK, a blank signal BLANK and vertical/horizontal synchronizing signals Vsync and Hsync inputted from the exterior thereof. The controller 106 controls the data array 108, the frame memory 112 and the timing signal generator 116 on a basis of such external signals.

Generally, a driving method of the PDP 100 is classified into "address display separated (ADS) system" and "address while sustaining (AWS) system". In the ADS system, the entire field is driven in a sequence of an address interval and a sustaining interval. On the other hand, in the AWS system, one field is divided into blocks including a plurality of scanning lines, and an address interval and a sustaining interval co-exist for each line block within one field.

In such a PDP driving method, one frame consists of a plurality of sub-fields to realize gray levels by a combination of the sub-fields. For instance, when it is intended to realize 256 gray levels, one frame interval is time-divided into 8 sub-fields.

In the ADS system, as shown in FIG. 2, each sub-field is again divided into a reset interval, an address interval and a sustaining interval. In the reset interval, the entire field is initialized. In the address interval, the cells 101 on which a data is to be displayed are selected by an address discharge. The selected cells 101 sustain the discharge in the sustaining interval. The sustaining interval is lengthened by each interval corresponding to $2^n$ depending on a weighting value of each sub-field. In other words, the sustaining interval involved in each of the first to eighth sub-fields is lengthened at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields. The brightness and the chrominance of a displayed image are determined in accordance with a combination of the sub-fields.

Referring now to FIG. 3, a data pulse DP is applied to the address electrode X in the address interval, whereas a scanning pulse-SCP and a sustaining pulse SUSP are applied to the scanning electrode Y in the address interval and the sustaining interval, respectively. A sustaining pulse SUSP with an identical phase is applied to the sustaining electrode Z. At a time in the address interval, an address discharge is generated between the address electrode X and the scanning electrode Y. At this time, a desired level of direct current voltage is applied to the sustaining electrode Z. This direct current voltage stabilizes an address discharge between the address electrode X and the scanning electrode Y. By this address discharge, a wall charge is accumulated in a dielectric layer within the cell 101 at b time. Subsequently, at c time when the sustaining interval is initiated, a sustaining discharge is generated between the scanning electrode Y and the sustaining electrode Z by the sustaining pulse SUSP applied to the scanning electrode Y. At d time when the sustaining pulse SUSP remains at a high level, a wall charge is accumulated in a dielectric layer within the cell 101. This wall charge causes a memory effect that allows an electric field within the cell 101 to be maintained. In other words, a sustaining discharge is caused by an electric field formed by the wall charge and an electric field formed by the sustaining pulse SUSP. Accordingly, a discharge is not generated within the cell 101 in which a wall charge is not formed even though the sustaining pulse SUSP is applied thereto. Then, the sustaining pulse SUSP is applied to the sustaining electrode Z. The sustaining pulse SUSP is alternately applied to the scanning electrode Y and the sustaining electrode Z in this manner to cause a sustaining discharge. At a time when the sustaining interval is terminated, an erasing pulse EP is applied to the scanning electrodes Y simultaneously. The erasing pulse EP is set to have lower pulse width and magnitude in comparison to the sustaining pulse SUSP.

On the other hand, in the AWS system, a plurality of (usually, four to eight) lines SL are set into a line block as shown in FIG. 4 and FIG. 5 assuming that a scanning line, that is, one row of cell should be one line. In such line blocks, each sub-field includes a write interval for simultaneously turning on cells in the entire field, an address interval for selecting the cells, a sustaining interval for maintaining a discharge of the cells that are not selected in the address interval, and a line erasing interval for erasing the sustaining discharge. Herein, the sustaining interval and the number of sustaining pulses is determined by a relative brightness ratio of each sub-field in similarity to the ADS system. Also, the same number of sustaining pulses at the sub-field determined in accordance with the relative brightness ratio is applied to the lines SL included in the same line block.

In the driving method of the PDP 100 as described above, an equal sustaining interval is allocated to lines in the entire field or lines included in the same line blocks at each sub-field and the same number of sustaining pulses are applied thereto. However, the PDP 100 has a different emission efficiency at each cell depending on a thickness of the fluorescent material, a height of the barrier rib, a residual electric charge difference and an electrode characteristic difference. Also, since the number of cells turned on for each line is different, the PDP 100 generates a load deviation for each line. As a result, the conventional PDP driving method allocates the equal sustaining interval and the same number of sustaining pulses without considering the load deviation per line, thereby causing a problem in that a brightness difference is generated between the lines. This problem will be described in detail with reference to FIGS. 6A and 6B that represent equivalent circuits of a single line.

Referring to FIGS. 6A and 6B, each of the scanning electrode Y and the sustaining electrode Z included in a single line can be represented by a line resistor R. Since a dielectric material exists between the scanning electrode Y and the sustaining electrode Z, it can be represented by a capacitor C. As the number of cells turned on at one line goes larger, that is, as a load of the line increases, the number of discharging cells becomes larger to that extent to generate a larger voltage drop as shown in FIG. 6A. For instance, if 180V and 0V are applied to the scanning electrode Y and the sustaining electrode Z at a specific line, respectively, then a voltage difference between the scanning electrode Y and the sustaining electrode Z becomes 158V much lower than 180V due to a voltage drop caused by the discharging cells. Otherwise, as the number of cells turned on at one line goes smaller, that is, as a load of the line decreases, the number of discharging cells becomes smaller to that extent to generate a smaller voltage drop as shown in FIG. 6B. For instance, if a voltage difference between the scanning electrode Y and the sustaining electrode Z at a specific line caused by the sustaining pulse is 180V, then a voltage difference between the scanning electrode Y and the sustaining electrode Z becomes about 178V due to a voltage drop of about 2V occurring at a few cells. As a result, in the equal sustaining interval, a brightness at a line having a small load becomes higher that that at a line having a large load.

SUMMARY OF THE INVENTION

Accordingly, it is an object of the present invention to provide a line erasing method for a PDP that is capable of reducing a brightness difference between lines in the PDP.

In order to achieve these and other objects of the invention, a line erasing method for the plasma display panel according to one aspect of the present invention includes the steps of detecting a load amount per line for lines including a pair of electrodes for causing a sustaining discharge; and controlling the sustaining interval in accordance with a deviation in the load amount per line.

A line erasing method for the plasma display panel according to another aspect of the present invention includes the steps of detecting a load amount per line for lines including a pair of electrodes for causing a sustaining discharge; and controlling an erasure discharge for erasing the sustaining discharge for each line in accordance with a deviation in the load amount per line.

A line erasing method for the plasma display panel according to still another aspect of the present invention includes the steps of detecting a load amount for each of a desired number of lines for lines including a pair of electrodes for causing a sustaining discharge; and controlling an erasure discharge for erasing the sustaining discharge for each of the desired number of lines in accordance with a deviation in the load amount detected for each of the desired number of lines.

A line erasing apparatus for the plasma display panel according to still another aspect of the present invention includes load detecting means for detecting a load amount per line for lines including a pair of electrodes for causing a sustaining discharge; and sustaining control means for controlling the sustaining interval in accordance with a deviation in the load amount per line.

A line erasing apparatus for the plasma display panel according to still another aspect of the present invention includes load detecting means for detecting a load amount per line for lines including a pair of electrodes for causing a sustaining discharge; and erasure control means for controlling an erasure discharge for erasing the sustaining discharge for each line in accordance with a deviation in the load amount per line.

A line erasing apparatus for the plasma display panel according to still another aspect of the present invention includes load detecting means for detecting a load amount for each of a desired number of lines for lines including a pair of electrodes for causing a sustaining discharge; and erasure control means for controlling an erasure discharge for erasing the sustaining discharge for each of the desired number of lines in accordance with a deviation in the load amount detected for each of the desired number of lines.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
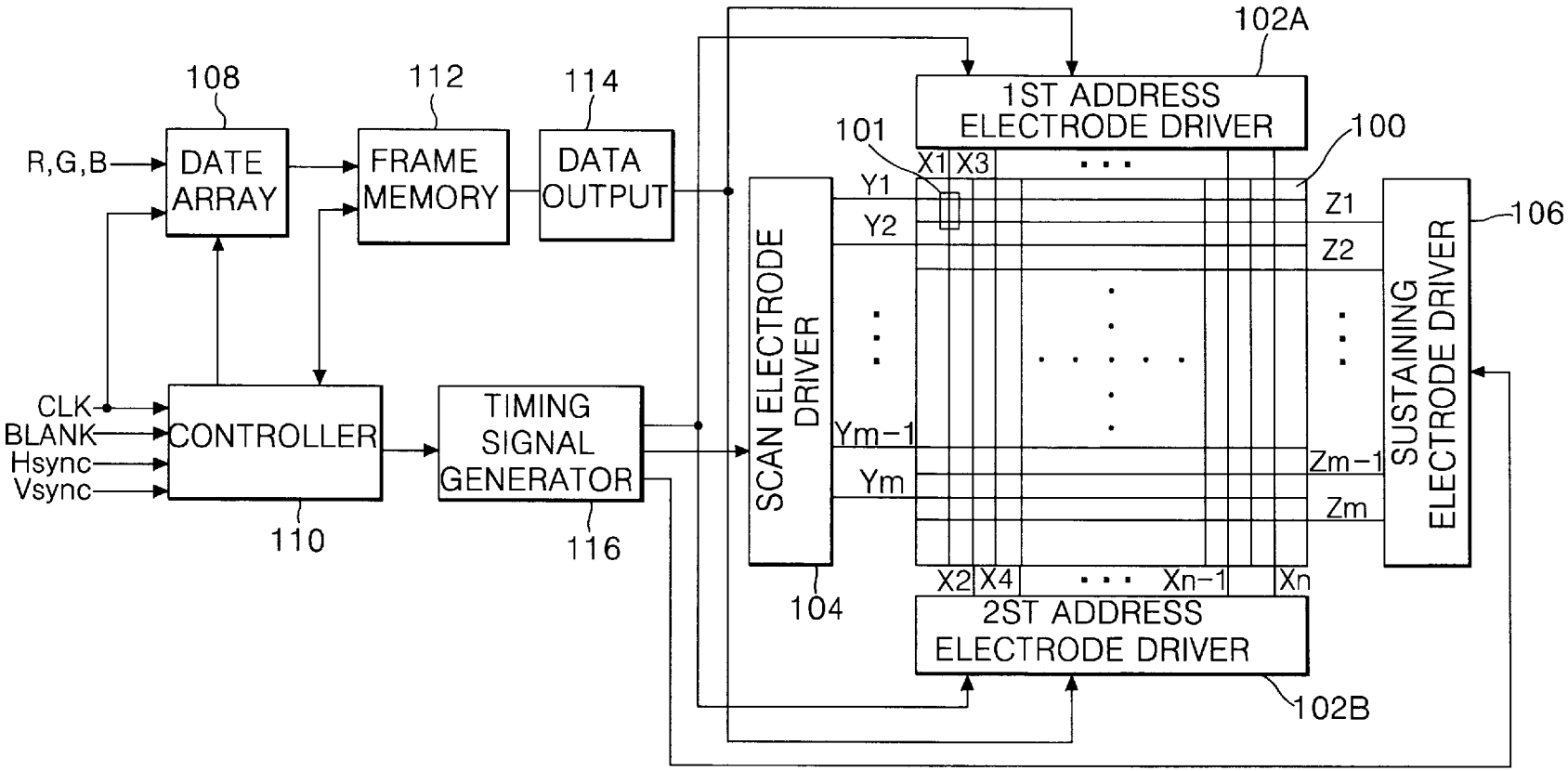
FIG.1 PRIOR ART
FIG. 1 is a schematic block diagram showing a configuration of a conventional AC-type PDP driving apparatus.
Figure 2:
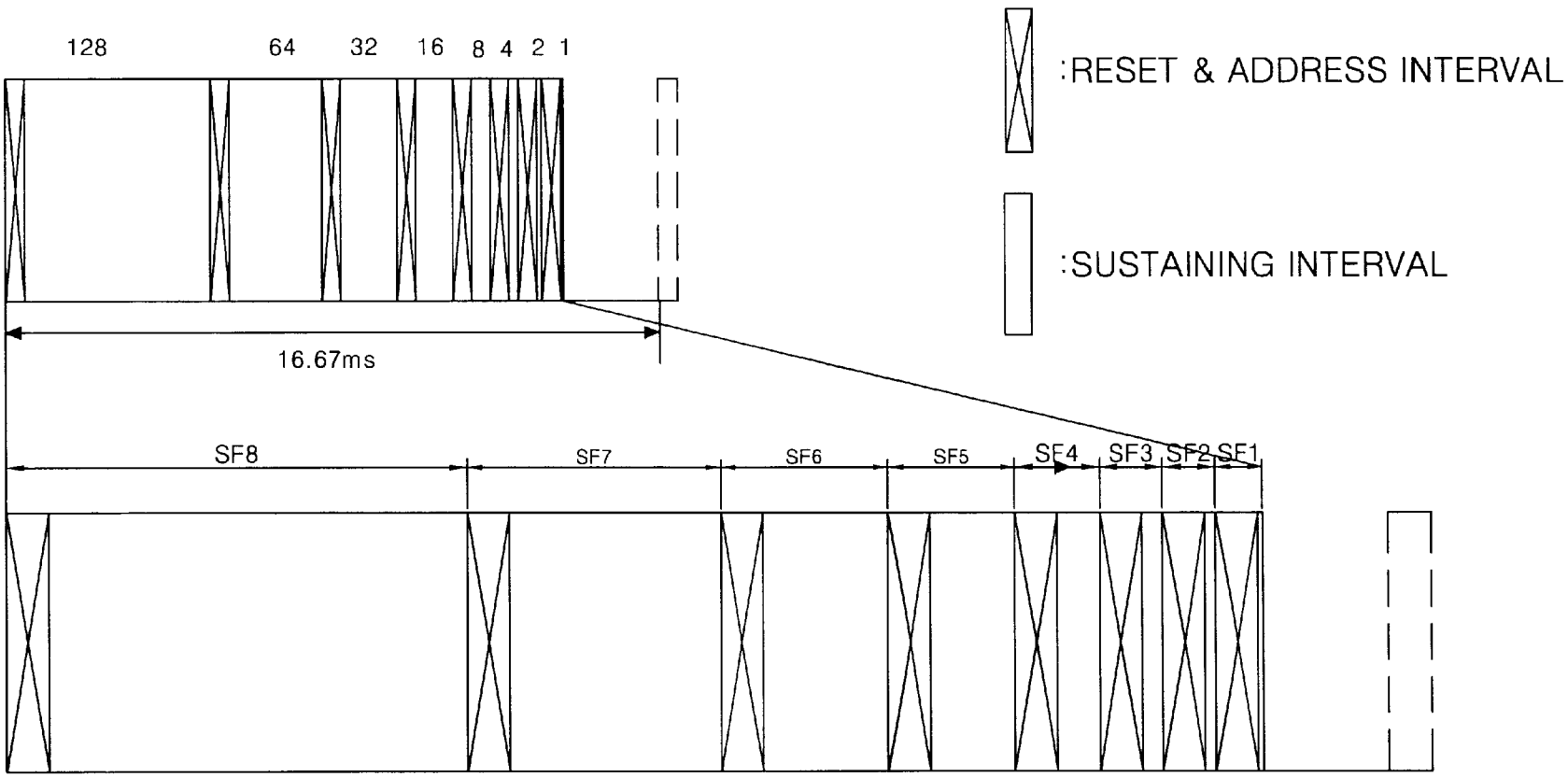
FIG.2 PRIOR ART
FIG. 2 illustrates a sub-field arrangement in the conventional ADS system.
Figure 3:
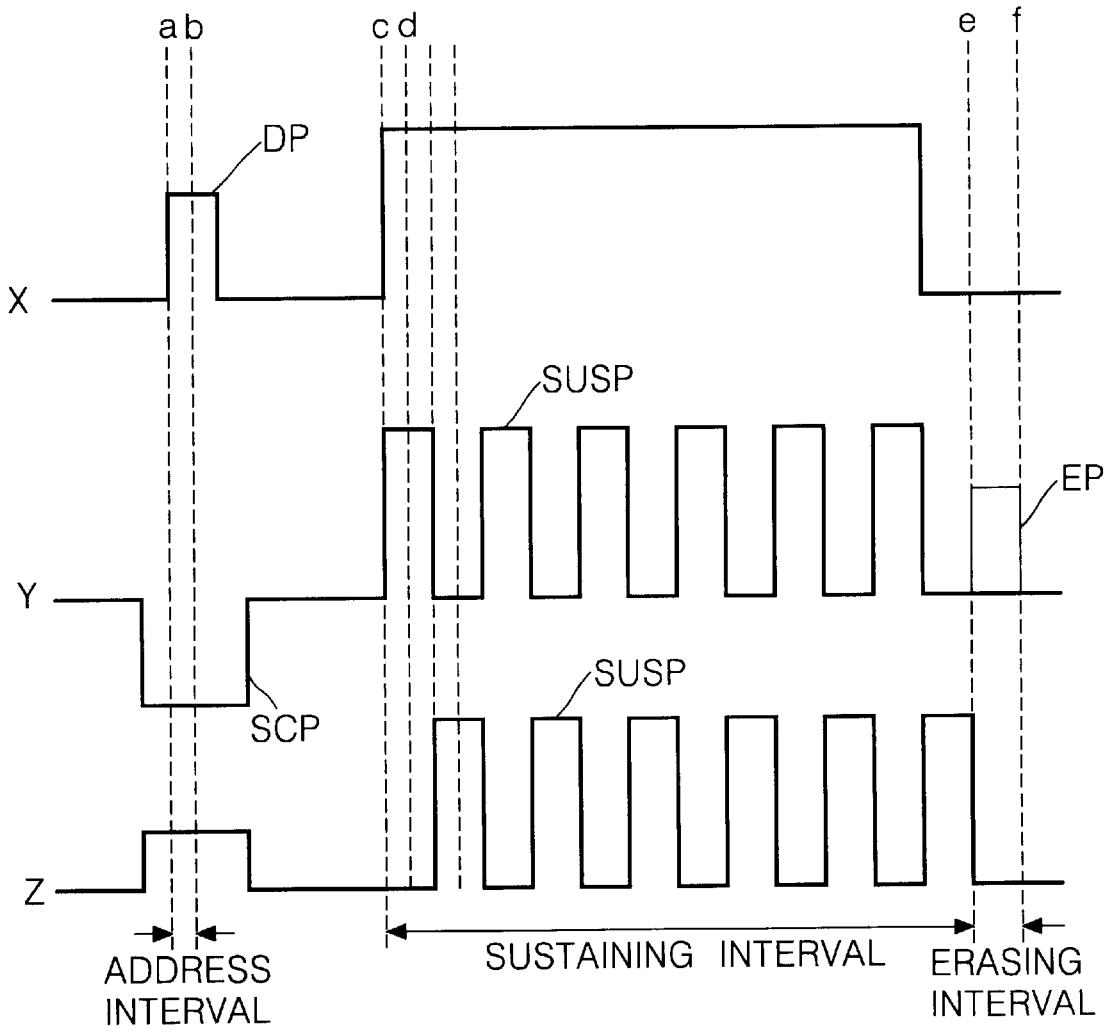
FIG.3 PRIOR ART
FIG. 3 is a schematic waveform diagram of a conventional PDP driving pulse.
Figure 4:
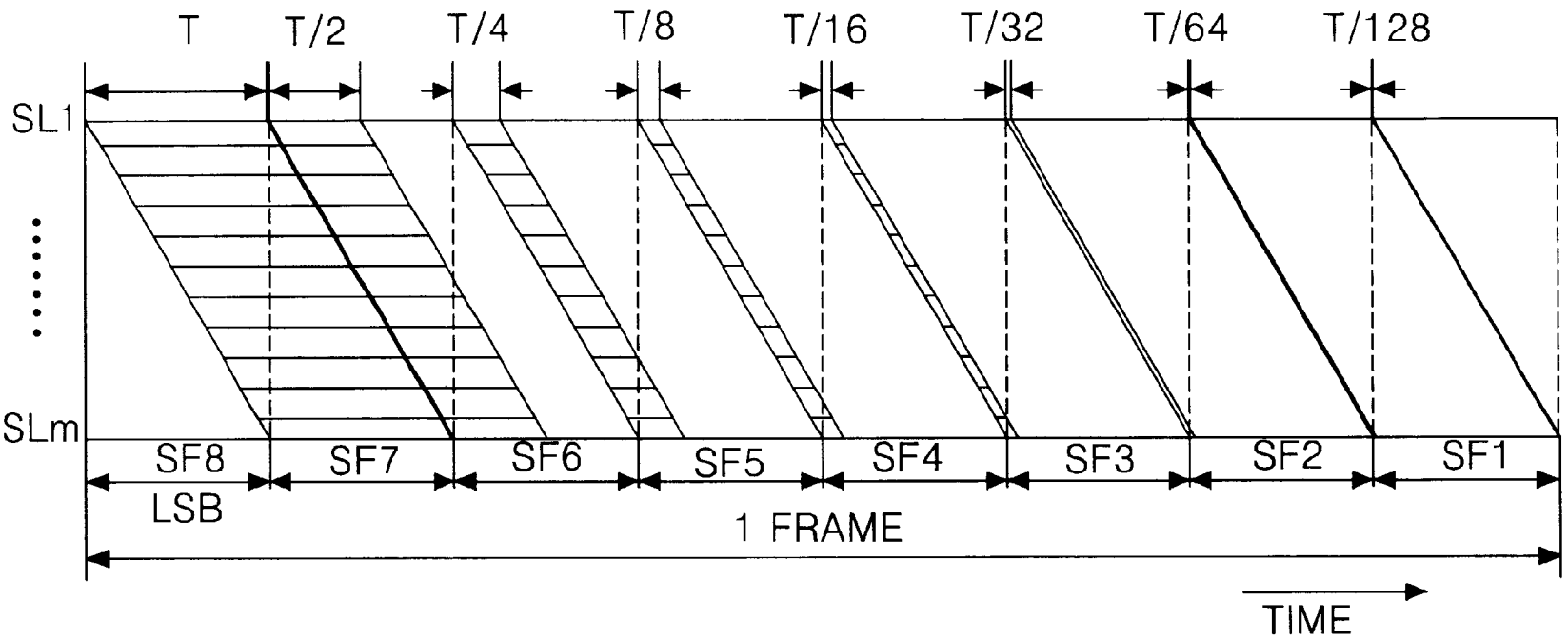
FIG. 4 PRIOR ART
FIG. 4 illustrates a sub-field arrangement in the conventional AWS system.
Figure 5:
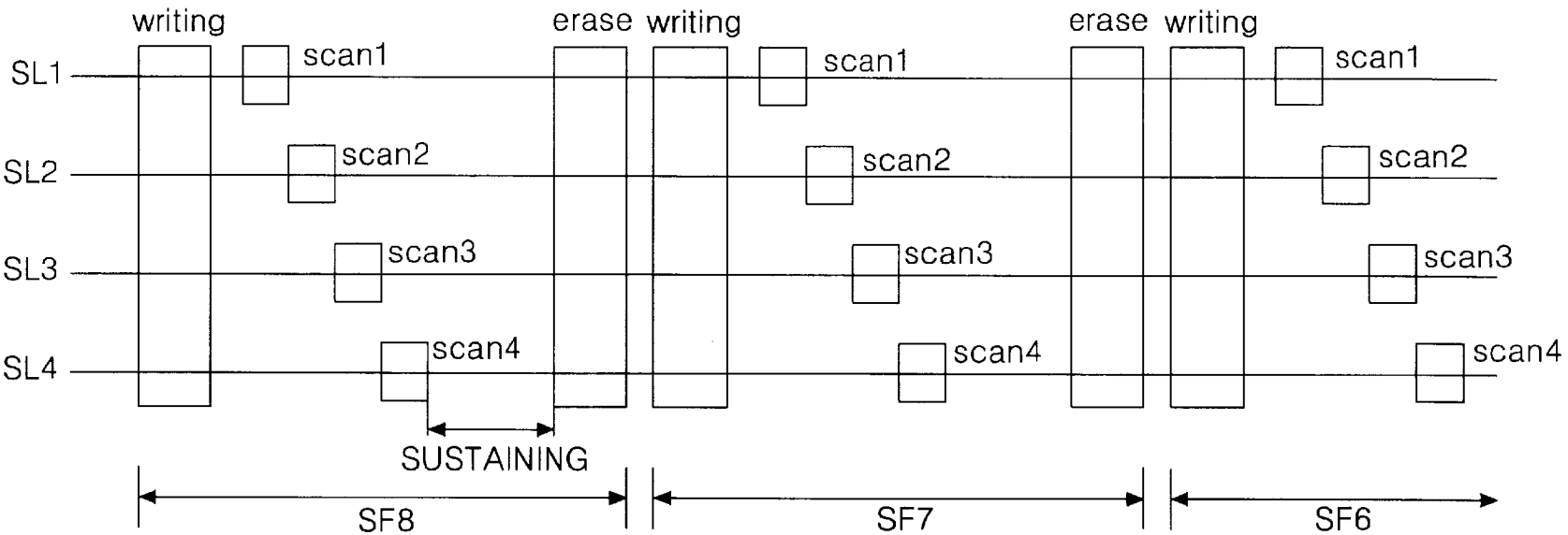
FIG. 5 PRIOR ART
FIG. 5 illustrates a sub-field arrangement in the conventional AWS system for four lines.
Figure 6A:
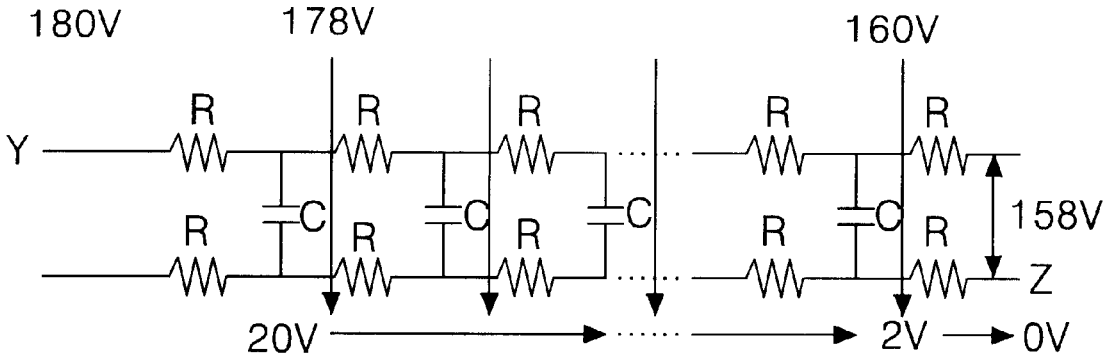
FIG. 6A PRIOR ART
FIGS. 6A and 6B are equivalent circuit diagrams of a single line for explaining a voltage drop having a different value in accordance with a load amount.
Figure 6B:
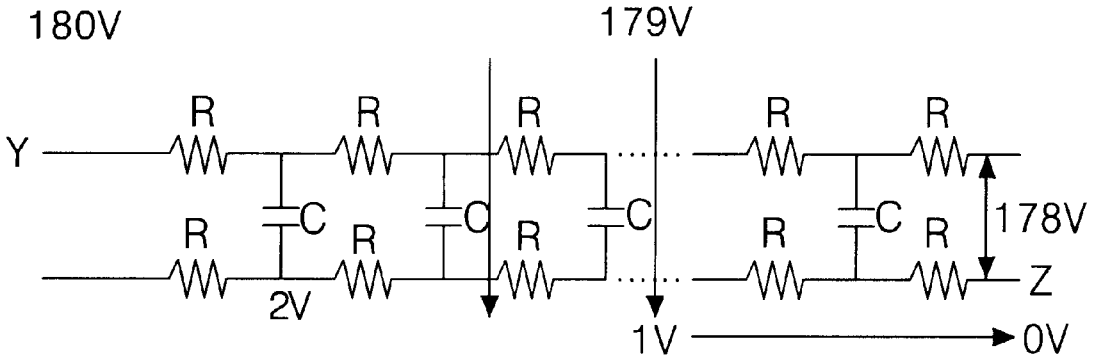
FIG. 6B PRIOR ART
Figure 7:
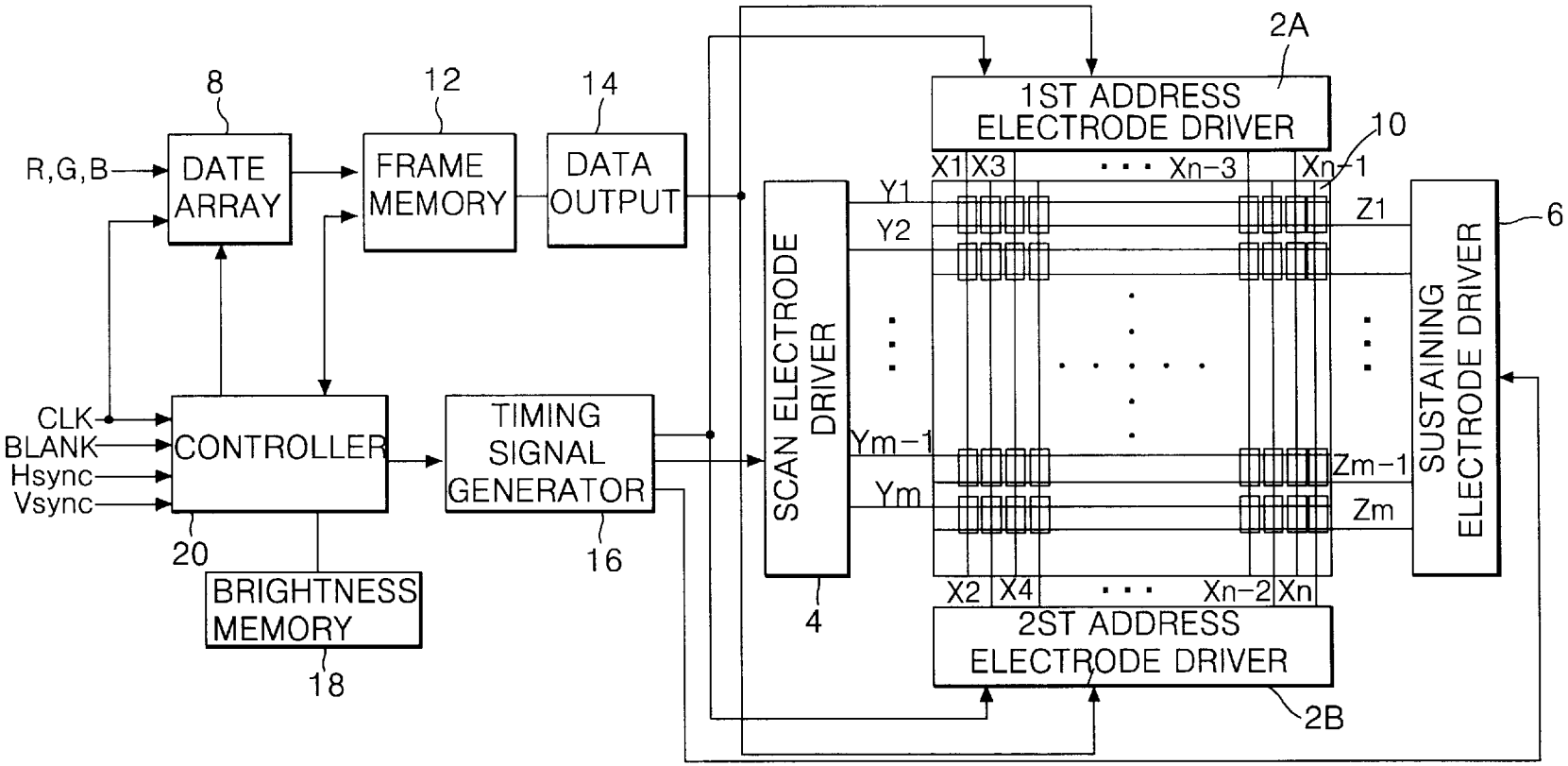
FIG. 7 is a block diagram showing a configuration of a line erasing apparatus for a PDP according to a first embodiment of the present invention.
Figure 8:
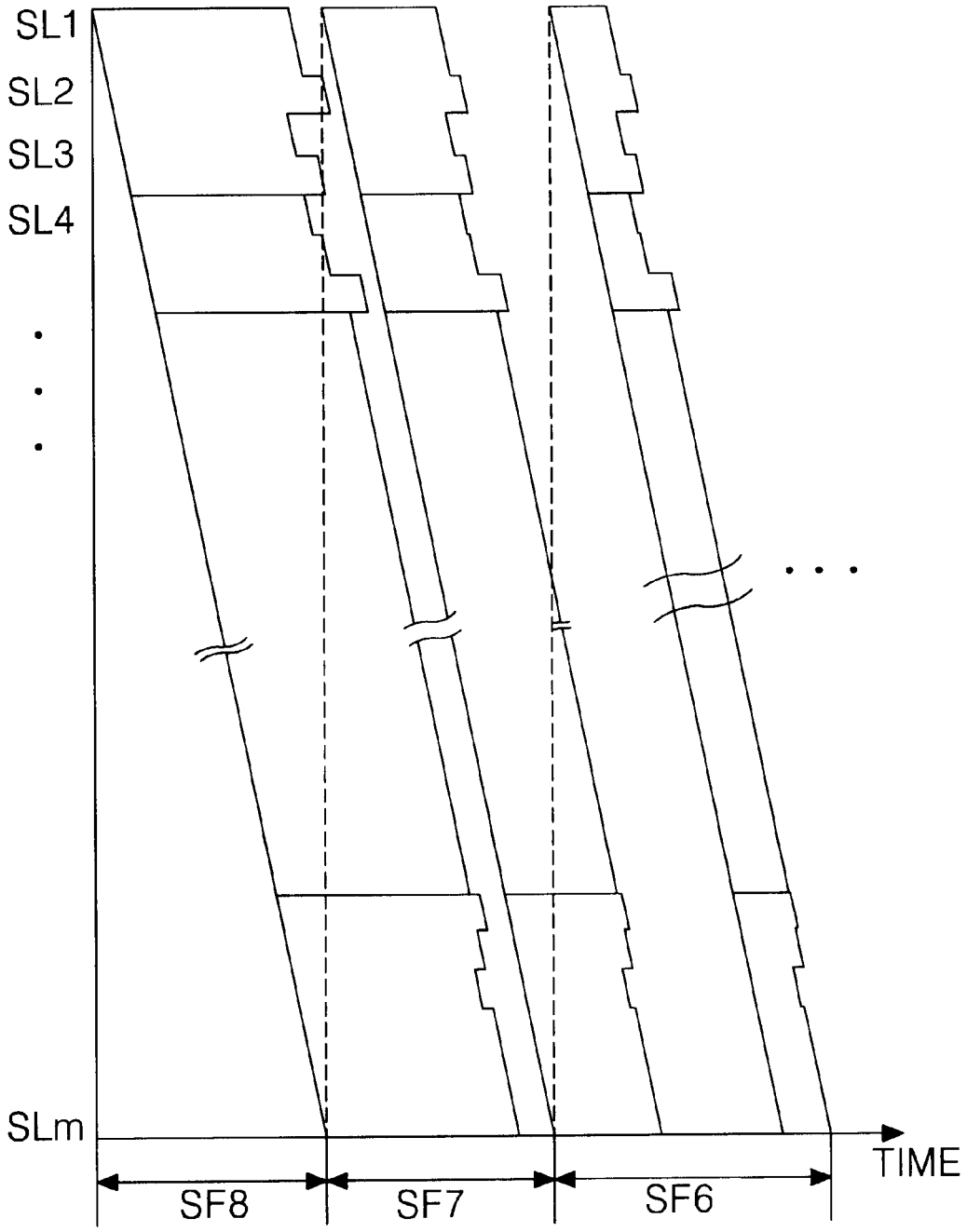
FIG. 8 is a view of explaining a line erasing method of the PDP according to the first embodiment of the present invention.

Referring to FIG. 7, there is shown a line erasing apparatus for a plasma display panel (PDP) according to a first embodiment of the present invention. The line erasing apparatus includes a data array 8 receiving a video data from an input line, a frame memory 12 and a data output 14 connected between the data array 8 and address electrode drivers 2A and 2B, a controller 20 for controlling the data array 8 and the frame memory 12, a timing signal generator 16 for generating a timing signal under control of the controller 20, and a brightness memory 18 for storing a brightness correction value for each line. The data array 8 rearranges the input video data for each bit under control of the controller 20. The frame memory 12 stores a bit data inputted from the data array 8 under control of the controller 20 and supplies a data output 14 with the stored bit data. The data output 14 divides a data from the frame memory 12 into one for odd-numbered cells and one for even-numbered cells to supply the divided data to the address electrode drivers 2A and 2B. Under control of the controller 20, the timing signal generator 16 applies timing signals required for the address electrode drivers 2A and 2B, the scanning electrode driver 4 and the sustaining electrode driver 6. The controller 20 receives a clock signal CLK, a blank signal BLANK and vertical/horizontal synchronizing signals Vsync and Hsync inputted from the exterior thereof. The controller 20 controls the data array 8, the frame memory 12 and the timing signal generator 16 on a basis of such external signals. The brightness memory 18 plays a role to store a brightness correction value for each line and to supply the controller 20 with the stored brightness correction value at a request of the controller 20. The brightness correction value is determined differently for each line depending on a deviation in emission efficiency per line or a load amount per line. The controller 20 controls the timing signal generator 16 on a basis of the brightness correction value per line inputted from the brightness memory 18 to control an application time of an erasing pulse to the scanning electrode Y. Accordingly, the sustaining interval is set to have a different value depending on an emission efficiency per line or a load amount per line at the same sub-field, FIG. 8 is a frame construction view for explaining a line erasing method for a PDP according to the first embodiment of the present invention at three sub-fields. Referring to FIG. 8, the line erasing method divides one frame into Y sub-fields so as to realize $2^x$ gray scales(wherein X and Y are integers and X Y). Each sub-field is divided into a write interval, an address interval, a sustaining interval and a line-erasing interval. Herein, the sustaining interval of each sub-field is determined by a relative brightness ratio of a picture data and adjusted in accordance with a brightness correction value per line. For instance, sustaining intervals of the first and fourth lines SL1 and SL4 are reference sustaining intervals determined in accordance with the relative brightness ratio at a line block including first to fourth lines SL1 to SL4 as shown in FIG. 8. On the other hand, a sustaining interval of the second line SL2 is longer than the reference sustaining interval while a sustaining interval of the third line SL3 is shorter than the reference sustaining interval. As the sustaining interval is adjusted in this manner, an application time of an erasing pulse is adjusted, too.

Figure 9:
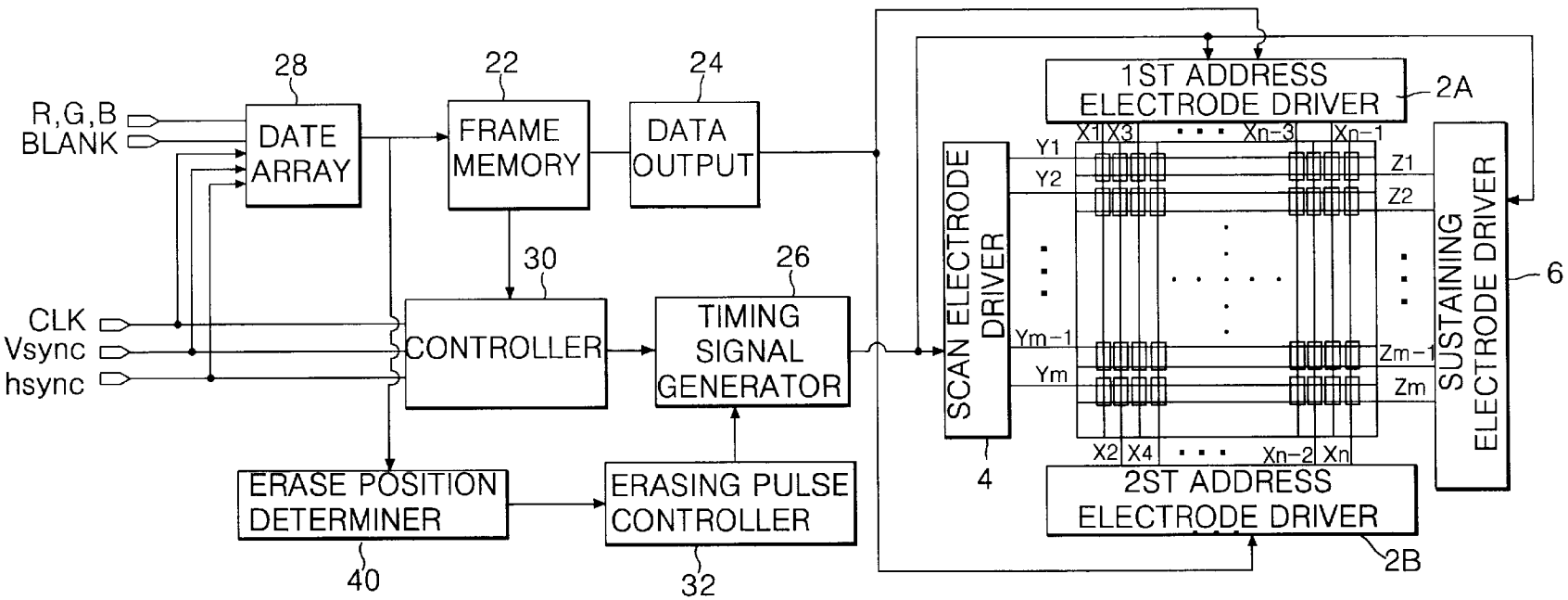
FIG. 9 is a block diagram showing a configuration of a line erasing apparatus for a PDP according to a second embodiment of the present invention.

Referring now to FIG. 9, there is shown a line erasing apparatus for a plasma display panel (PDP) according to a second embodiment of the present invention. The line erasing apparatus includes a data array 28 receiving a video data from an input line, a frame memory 22 and a data output 24 connected between the data array 28 and address electrode drivers 2A and 2B, a controller 30 for controlling the data array 28 and the frame memory 22, a timing signal generator 26 for generating a timing signal under control of the controller 30, and an erasure position determiner 40 and an erasing pulse controller 32 connected, in series, between the data array 28 and the timing signal generator 26. The data array 28 rearranges the input video data for each bit in response to a blank signal BLANK and vertical/horizontal synchronizing signals Vsync and Hsync. The frame memory 22 stores a bit data inputted from the data array 28 under control of the controller 30 and supplies a data output 24 with the stored bit data. The data output 24 divides a data from the frame memory 22 into one for odd-numbered cells and one for even-numbered cells to supply the divided data to the address electrode drivers 2A and 2B. Under control of the controller 30, the timing signal generator 26 applies a data latch signal to the address electrode drivers 2A and 2B and, at the same time, applies a write pulse, a scanning pulse and a sustaining pulse to the scanning electrode driver 4. Also, the timing signal generator 26 applies a timing signal instructing an application time of the erasing pulse coupled for each line to the scanning electrode driver 4 and the sustaining electrode driver 6 under control of the erasing pulse controller 32.

The controller 30 receives a clock signal CLK and vertical/horizontal synchronizing signals Vsync and Hsync inputted from the exterior thereof. The controller 30 controls the data array 28, the frame memory 22 and the timing signal generator 26 on a basis of such external signals. The erasure position determiner 40 compares a calculated average value of a bit data per line, that is, a load amount per line with a predetermined reference value to determine an erasure position for each line on a basis of the compared result. Herein, when an average value of the bit data per line is larger than the reference value, that is, when a load amount at the corresponding line is large, an erasure position of the corresponding line is relatively retarded in comparison to that of other line. Otherwise, when an average value of the bit data per line is smaller than the reference value, that is, when a load amount at the corresponding line is small, an erasure position of the corresponding line is relatively advanced in comparison to that of other line. The erasure position determiner 40 can calculate a load amount per line at the entire sub-field, that is, from a least significant bit (LSB) into a most significant bit (MSB) to determine an erasure position per line at the entire sub-field, but it may calculate an erasure position per line only at a portion of the sub-field to determine an erasure position per line at a portion of the sub-field. For instance, high order sub-fields assigned with high order bits have a high relative brightness ratio. A sustaining interval and a sustaining discharge frequency of such high order sub-fields are larger than those of the low order sub-fields to make a large affect to the brightness. Accordingly, when the erasure position determiner 40 calculates a load amount per line at a portion of sub-fields, it does not calculate a load amount per line at the low order sub-fields, but calculates a load amount per line only at the high order sub-fields. The erasing pulse controller 32 controls the timing signal generator 26 on a basis of an erasure position information inputted from the erasure position determiner 40 to adjust an application time of an erasing pulse to the scanning electrodes Y1 to Ym.

FIG. 10 through FIG. 13 are frame construction views for explaining line erasing methods of a PDP according to other embodiments of the present invention for four lines. Such line erasing methods will be described in conjunction with the line erasing apparatus shown in FIG. 9.

Figure 10:
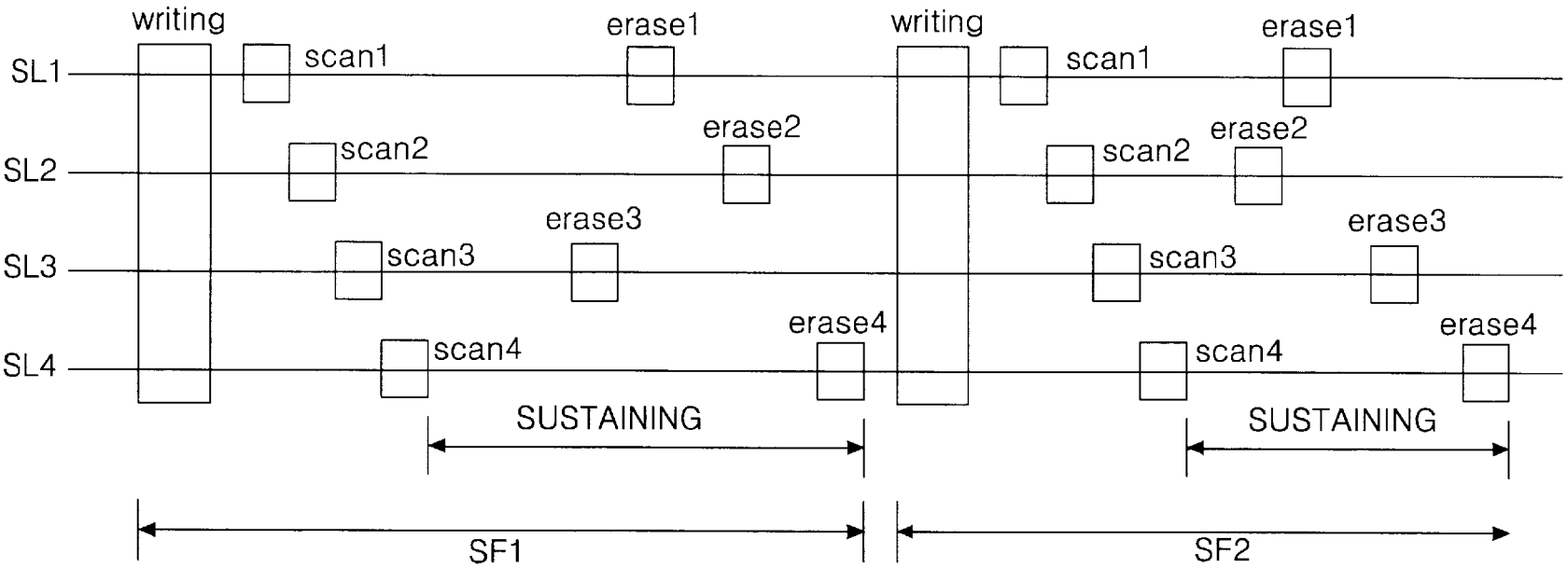
FIG. 10 is a view of explaining a line erasing method of the PDP according to the second embodiment of the present invention.

Referring to FIG. 10, a line erasing method according to a second embodiment of the present invention divides one frame into Y sub-fields so as to realize $2^x$ gray scales (wherein X and Y are integers and X Y) and adjusts an application time of an erasing pulse to the first to fourth lines SL1 to SL4 differently for each of the lines SL1 to SL4 at each sub-field. Each sub-field is divided into a write interval, an address interval, a sustaining interval and a line erasing interval. A writing discharge is generated at the same time for each sub-field at all the cells on the first to fourth lines SL1 to SL4. Subsequently, an erasing address discharge is caused by a voltage difference between a data pulse applied to the address electrode lines X1 to Xn and a scanning pulse applied to the scanning electrodes Y1 to Ym in the address interval. The cells having not generating the erasing address discharge make a sustaining discharge at each line SL1 to SL4 by a sustaining pulse applied to the scanning electrodes Y1 to Ym and the sustaining electrodes Z1 to Zm alternately. Finally, a line erasing pulse is applied to the lines SL1 to SL4 at a different time by an erasure position information produced from the erasure position determiner 40 to generate an erasure discharge at a different time for each line. For instance, an erasing pulse applied to the first line SL1 at the first sub-field SF1 is slower than that applied to the third line SL3 while being faster than that applied to the second and fourth lines SL2 and SL4. The sustaining interval of the first sub-field SF1 becomes different at the first to fourth lines SL1 to SL4 in response to such an erasing pulse application time. In other words, at the first sub-field SF1, sustaining intervals of the first to fourth lines SL1 to SL4 is shortest in the third line SL3 and lengthened in a sequence of the first line SL1, the second line SL2 and the fourth line SL4. An erasing pulse application time is set to have a different value for each line at other sub-fields except for the first sub-field SF1. To this end, the erasure position determiner 40 calculates an average value of a bit data per line at all the sub-fields to compare it with a reference value, and determines an erasure position for each line at all the sub-fields in accordance with the compared result.

Meanwhile, if an erasure position is controlled for each line as shown in FIG. 10, then a fine adjustment is needed and a image coarser slightly than an original image may be displayed on the field. To this end, the line erasing method according to the present invention does not control an erasing pulse application time for each line, but it may control an erasing pulse application time for a desired number of lines.

Figure 11:
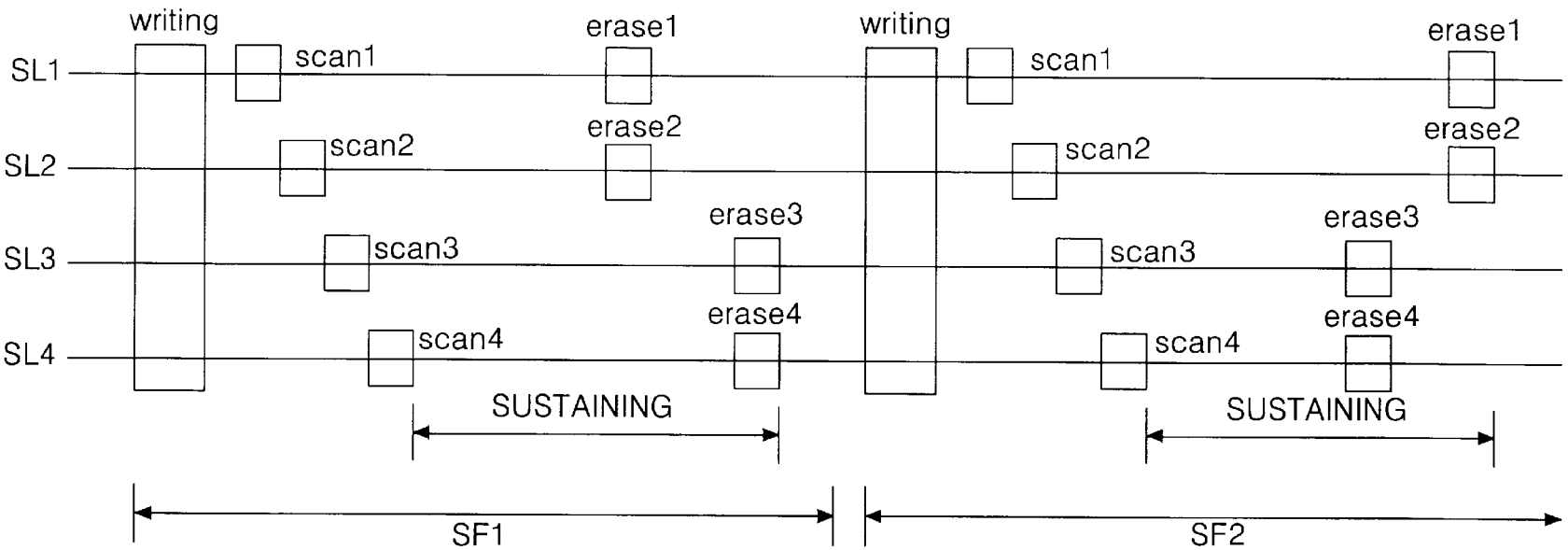
FIG. 11 is a view of explaining a line erasing method of the PDP according to a third embodiment of the present invention.

Referring to FIG. 11, a line erasing method according to a third embodiment of the present invention divides one frame into Y sub-fields so as to realize $2^x$ gray scales (wherein X and Y are integers and X Y) and adjusts an application time of an erasing pulse to the first to fourth lines SL1 to SL4 differently for two lines at each sub-field. Each sub-field is divided into a write interval, an address interval, a sustaining interval and a line erasing interval. A writing discharge is generated at the same time for each sub-field at all the cells on the first to fourth lines SL1 to SL4. Subsequently, an erasing address discharge for selecting the cells is caused by a voltage difference between a data pulse applied to the address electrode lines X1 to Xn and a scanning pulse applied to the scanning electrodes Y1 to Ym in the address interval. The cells having not generating the erasing address discharge make a sustaining discharge at each line SL1 to SL4 by a sustaining pulse applied to the scanning electrodes Y1 to Ym and the sustaining electrodes Z1 to Zm alternately. Finally, a line erasing pulse is applied for every two lines to cause an erasing discharge for two lines adjacent to each other. For instance, an erasing pulse applied to the third and fourth lines SL3 and SL4 simultaneously is coupled at a different time from that applied to the first and second lines SL1 and SL2. At the first sub-field SF1, an erasing pulse applied to the first and second lines SL1 and SL2 is faster than that applied to the third and fourth lines SL3 and SL4. An erasing pulse application time is set to have a different value for each of a desired number of lines at other sub-fields except for the first sub-field SF1. To this end, the erasure position determiner 40 calculates an average value of a bit data per two lines at all the sub-fields to compare it with a reference value, and determines an erasure position for each of two lines at all the sub-fields in accordance with the compared result.

Figure 12:
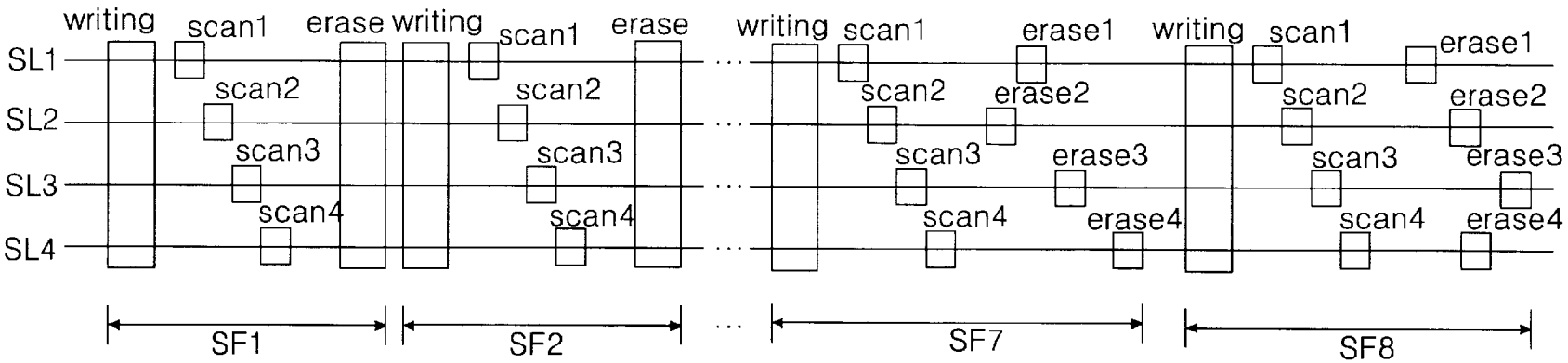
FIG. 12 is a view of explaining a line erasing method of the PDP according to a fourth second embodiment of the present invention.

Referring to FIG. 12, a line erasing method according to a fourth embodiment of the present invention divides one frame into Y sub-fields so as to realize $2^x$ gray scales (wherein X and Y are integers and X Y) and adjusts an application time of an erasing pulse differently for each line only at a portion of sub-fields. Each sub-field SF1 to SF8 is divided into a write interval, an address interval, a sustaining interval and a line erasing interval. Cells at the entire field are turned on by a writing discharge in the write interval, and cells are selected by an erasing address discharge in the address interval. In the sustaining interval, the cells having not generated the erasing address discharge make a sustaining discharge whenever a sustaining pulse is generated. These write interval, address interval and sustaining interval becomes equal at all the sub-fields. Otherwise, the erasing interval is controlled differently at the high order sub-fields having a low relative brightness ratio and the low order sub-fields having a high relative brightness ratio. For instance, the first to fourth lines SL1 to SL4 are erasure-discharged simultaneously at the first to fourth sub-fields SF1 to SF4, whereas the first to fourth lines SL1 to SL4 are erasure-discharged at a different time for each line at the fifth to eighth sub-fields SF5 to SF8. Herein, the high order sub-fields generating an erasing discharge at a different time for each line are not limited to the fifth to eighth sub-fields SF5 to SF8, but at least one of high order sub-field may be selected like the seventh and eighth sub-fields SF7 and SF8. In order to control an erasing discharge per line at the high order sub-fields in this manner, the erasure position determiner 40 calculates an average value of a bit data per line at the high order sub-fields to compare it with a reference value, and determines an erasure position for each line at the high order sub-fields in accordance with the compared result.

Figure 13:
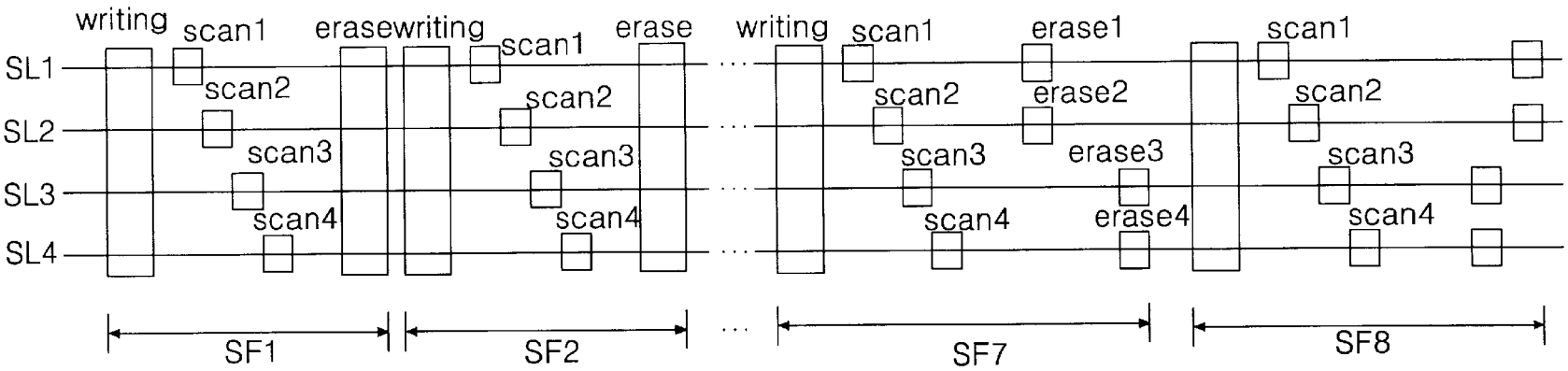
FIG. 13 is a view of explaining a line erasing method of the PDP according to a fifth embodiment of the present invention.

Referring to FIG. 13, a line erasing method according to a fifth embodiment of the present invention divides one frame into Y sub-fields so as to realize $2^x$ gray scales (wherein X and Y are integers and X Y) and adjusts an application time of an erasing pulse differently for each of two lines only at a portion of sub-fields. Each sub-field SF1 to SF8 is divided into a write interval, an address interval, a sustaining interval and a line erasing interval. These write interval, address interval and sustaining interval are identical to those in the above-mentioned embodiments at all the sub-fields. For instance, the first to fourth lines SL1 to SL4 are erasure-discharged simultaneously at the first to fourth sub-fields SF1 to SF4, whereas the first to fourth lines SL1 to SL4 are erasure-discharged at a different time for each of a desired number of lines at the fifth to eighth sub-fields SF5 to SF8. Herein, the high order sub-fields generating an erasing discharge for each of a desired number of lines are not limited to the fifth to eighth sub-fields SF5 to SF8, but at least one of high order sub-field may be selected like the seventh and eighth sub-fields SF7 and SF8. In order to control an erasing discharge for each of a desired number of lines at the high order sub-fields in this manner, the erasure position determiner 40 calculates an average value of a bit data per a desired number of lines at the high order sub-fields to compare it with a reference value, and determines an erasure position for each of a desired number of lines at the high order sub-fields in accordance with the compared result.

As described above, according to the present invention, the brightness control information per line determined in accordance with an emission efficiency deviation per line or a load amount per line is utilized, or an input video data is divided into one for each sub-field and for one for each line to calculate an average value of a bit data per line and compare the calculated average value with a predetermined reference value, thereby determining a load amount per line by the compared difference to control a sustaining interval or an application time of an erasing pulse for each line. Furthermore, a sustaining interval per line or an application time of an erasing pulse is controlled in accordance with a load amount per line only for the sub-fields having a high relative brightness ratio. As a result, a sustaining discharge frequency is controlled for each line in accordance with a load amount per line, so that it is possible to minimize a brightness difference per line generated in accordance with a load amount per line.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A line erasing method for a plasma display panel wherein a single frame is divided into a plurality of sub-fields, comprising:

detecting a load amount per line for lines including a pair of electrodes for causing a sustaining discharge;

controlling a sustaining interval in accordance with a deviation in the load amount per line; and adjusting the sustaining interval by controlling an application time of an erasing pulse for erasing the sustaining discharge.

2. The line erasing method as claimed in claim 1, wherein controlling the sustaining interval further comprising:

comparing the detected load amount per line with a predetermined reference value;

lengthening the sustaining interval when the detected load amount per line is larger than the predetermined reference value; and shortening the sustaining interval when the detected load amount per line is smaller than the predetermined reference value.

3. The line erasing method as claimed in claim 1, wherein the load amount per line is determined by dividing an input video data into one for each sub-field and one for each line to calculate an average value of a bit data per line and then comparing the calculated average value with the predetermined reference value to use the compared difference value.

4. The line erasing method as claimed in claim 1, wherein detecting the load amount per line and controlling the sustaining interval are carried out at a portion of the sub-fields.

5. The line erasing method as claimed in claim 1, wherein the portion of sub-fields is at least one of high order sub-field set to have a high relative brightness ratio.

6. A line erasing method for a plasma display panel wherein a single frame is divided into a plurality of sub-fields, comprising:

detecting a load amount per line for lines including a pair of electrodes for causing a sustaining discharge; and controlling an erasure discharge for erasing the sustaining discharge for each line in accordance with a deviation in the load amount per line.

7. The line erasing method as claimed in claim 6, wherein controlling the erasure discharge further comprising:

comparing the detected load amount per line with a pre determined reference value;

delaying an application time of an erasing pulse into a time later than a predetermined reference time when the detected load amount per line is larger than the predetermined reference value; and advancing an application time of an erasing pulse into a time earlier than a predetermined reference time when the detected load amount per line is smaller than the predetermined reference value.

8. The line erasing method as claimed in claim 6, wherein the load amount per line is determined by dividing an input video data into one for each sub-field and one for each line to calculate an average value of a bit data per line and then comparing the calculated average value with the predetermined reference value to use the compared difference value.

9. The line erasing method as claimed in claim 6, wherein detecting the load amount per line and controlling the erasure discharge are carried out at least one of high order sub-field set to have a high relative brightness ratio.

10. A line erasing method for a plasma display panel wherein a single frame is divided into a plurality of sub-fields, comprising:

detecting a load amount for each of a desired number of lines for lines including a pair of electrodes for causing a sustaining discharge; and controlling an erasure discharge for erasing the sustaining discharge for each of the desired number of lines in accordance with a deviation in the load amount detected for each of the desired number of lines.

11. The line erasing method as claimed in claim 10, wherein controlling the erasure discharge further comprising:

comparing the load amount detected for each of the number of lines with a predetermined reference value;

delaying an application time of an erasing pulse into a time later than a predetermined reference time when the load amount detected for each of the desired number of lines is larger than the predetermined reference value; and advancing an application time of an erasing pulse into a time earlier than a predetermined reference time when the load amount detected for each of the desired number of lines is smaller than the predetermined reference value.

12. The line erasing method as claimed in claim 10, wherein the load amount for each of the desired number of lines is determined by dividing an input video data into one for each sub-field and one for each line to calculate an average value of a bit data per line and then comparing the calculated average value with the predetermined reference value to use the compared difference value.

13. The line erasing method as claimed in claim 10, wherein detecting the load amount for each of the desired number of lines and controlling the erasure discharge are carried out at least one of high order sub-field set to have a high relative brightness ratio.

14. A line erasing apparatus for a plasma display panel wherein a single frame is divided into a plurality of sub-fields, comprising:

a load detector configured to detecting a load amount per line for lines including a pair of electrodes for causing a sustaining discharge;

a controller configured to controlling the sustaining interval in accordance with a deviation in the load amount per line; and a sustaining interval adjustor configured to adjusting an application time of an erasing pulse for erasing the sustaining discharge.

15. The line erasing apparatus as claimed in claim 14, wherein the controller compares the detected load amount per line with a predetermined reference value to lengthen the sustaining interval when the detected load amount per line is larger than the predetermined reference value and shortens the sustaining interval when the detected load amount per line is smaller than the predetermined reference value.

16. The line erasing apparatus as claimed in claim 14, wherein the load detector divides an input video data into one for each sub-field and one for each line to calculate an average value of a bit data per line and then compares the calculated average value with the predetermined reference value, thereby detecting the load amount per line in accordance with the compared difference value.

17. The line erasing apparatus as claimed in claim 14, wherein the adjustor adjusts the sustaining interval for each line at a portion of the sub-fields.

18. The line erasing apparatus as claimed in claim 17, wherein the portion of the sub-fields is at least one of high order sub-field set to have a high relative brightness ratio.

19. A line erasing method for a plasma display panel wherein a single frame is divided into a plurality of sub-fields, comprising:

a load detector configured to detecting a load amount per line for lines including a pair of electrodes for causing a sustaining discharge; and an erasure controller configured to controlling an erasure discharge for erasing the sustaining discharge for each line in accordance with a deviation in the load amount per line.

20. The line erasing apparatus as claimed in claim 19, wherein the erasure controller compares the detected load amount per line with a predetermined reference value to delay an application time of an erasing pulse into a time later than a predetermined reference time when the detected load amount per line is larger than the predetermined reference value and advances an application time of an erasing pulse into a time earlier than a predetermined reference time when the detected load amount per line is smaller than the predetermined reference value.

21. The line erasing apparatus as claimed in claim 19, wherein the load detector divides an input video data into one for each sub-field and one for each line to calculate an average value of a bit data per line and then compares the calculated average value with the predetermined reference value, thereby detecting the load amount per line in accordance with the compared difference value.

22. The line erasing apparatus as claimed in claim 19, wherein the erasure controller controls an application time of the erasing pulse at least one of high order sub-field set to have a high relative brightness ratio.

23. A line erasing method for a plasma display panel wherein a single frame is divided into a plurality of sub-fields, comprising:

a load detector configured to detecting a load amount for each of a desired number of lines for lines including a pair of electrodes for causing a sustaining discharge; and an erasure controller configured to controlling an erasure discharge for erasing the sustaining discharge for each of the desired number of lines in accordance with a deviation in the load amount detected for each of the desired number of lines.

24. The line erasing apparatus as claimed in claim 23, wherein the erasure controller compares the load amount detected for each of the desired number of lines with a predetermined reference value to delay an application time of an erasing pulse into a time later than a predetermined reference time when the detected load amount detected for each of the desired number of lines is larger than the predetermined reference value and advances an application time of an erasing pulse into a time earlier than a predetermined reference time when the load amount detected for each of the desired number of lines is smaller than the predetermined reference value.

25. The line erasing apparatus as claimed in claim 23, wherein the load detector divides an input video data into one for each sub-field and one for each line to calculate an average value of a bit data per line and then compares the calculated average value with the predetermined reference value, thereby detecting the load amount for each of the desired number of lines in accordance with the compared difference value.

26. The line erasing apparatus as claimed in claim 23, wherein the erasure controller controls an application time of the erasing pulse at least one of high order sub-field set to have a high relative brightness ratio.

* * * * *